US007011253B2

(12) United States Patent
Nosker et al.

(10) Patent No.: US 7,011,253 B2
(45) Date of Patent: Mar. 14, 2006

(54) ENGINEERED RAILROAD TIES

(75) Inventors: Thomas Nosker, Stockton, NJ (US); Richard Renfree, Scotch Plains, NJ (US); James Kerstein, Watchung, NJ (US); Louis Simon, Branchburg, NJ (US)

(73) Assignee: Polywood, Inc., Edison, NJ (US)

( * ) Notice: Subject to any disclaimer, the term of this patent is extended or adjusted under 35 U.S.C. 154(b) by 375 days.

(21) Appl. No.: 09/985,937

(22) Filed: Nov. 6, 2001

(65) Prior Publication Data

US 2003/0085293 A1 May 8, 2003

(51) Int. Cl.
*E01B 3/00* (2006.01)

(52) U.S. Cl. ..... 238/30; 238/83

(58) Field of Classification Search ..... 238/29, 238/30, 45, 82–103, 109, 115, 119
See application file for complete search history.

(56) References Cited

U.S. PATENT DOCUMENTS

| | | | | | |
|---|---|---|---|---|---|
| 955,645 | A | * | 4/1910 | Holden | 238/117 |
| 1,297,828 | A | * | 3/1919 | Garber | 238/265 |
| 1,824,776 | A | * | 9/1931 | Hadley | 238/343 |
| 2,051,619 | A | * | 8/1936 | Reis | 238/105 |
| 2,128,530 | A | * | 8/1938 | Hadley | 238/377 |
| 4,925,094 | A | | 5/1990 | Buekett | |
| 5,104,039 | A | * | 4/1992 | Oestmann | 238/106 |
| 5,569,424 | A | | 10/1996 | Amour | |
| 5,605,282 | A | | 2/1997 | Snead | |
| 5,789,477 | A | | 8/1998 | Nosker et al. | |
| 5,799,870 | A | | 9/1998 | Bayer | |
| 5,886,078 | A | | 3/1999 | Sullivan et al. | |
| 5,916,932 | A | | 6/1999 | Nosker et al. | |
| 5,952,072 | A | | 9/1999 | Colby et al. | |
| 6,021,958 | A | | 2/2000 | Smith | |
| 6,045,052 | A | | 4/2000 | Besenschek | |
| 6,247,651 | B1 | * | 6/2001 | Marinelli | 238/84 |

* cited by examiner

*Primary Examiner*—Mark T. Le
(74) *Attorney, Agent, or Firm*—Millen, White, Zelano, Branigan, P.C.

(57) ABSTRACT

To increase the resistance of plastic and/or plastic composite railroad ties tosliding within the ballast of the railroad bed, for example, sliding lengthwise (in the direction of the longitudinal axis of the tie) and sideways (in the direction perpendicular to the longitudinal axis), ties with a textured surface which aids in anchoring the ties within the ballast of the railroad beds. In particular, the ties are provided with a pattern of indentations within a surface that contacts the ballast which increases the ties resistance to sliding. The pattern is molded into the ties so as to mechanically interact with the ballast (rocks) and provide as much resistance to sliding as possible, especially along the longitudinal axis of the tie but also in the direction perpendicular to the longitudinal axis.

26 Claims, 3 Drawing Sheets

ENGINEERED RAILROAD TIES

BACKGROUND OF THE INVENTION

The present invention relates to engineered railroad ties, methods of manufacturing same, and methods of using same. In particular, the present invention relates to railroad ties which resist sliding in the ballast of a railroad bed.

Railroad ties serve to support rails and also to maintain proper distance between rails under expected loads. Failure to adequately serve either of these roles can lead to a derailment, endangering both lives and property.

In general, a railroad tie must be able to maintain the desired distance between and under a lateral load of 24,000 lbs., a static vertical load of 39,000 lbs., and a dynamic vertical load of 140,000 lbs. Thus, for a typical railway wherein the distance (gauge) between the rails is 56.5 inches, the ties must be able to maintain this distance without increasing by more than 0.125 inches, under the expected temperature and load variations, so as to prevent derailment.

To effectively withstand such loads, the tie material must possess both stiffness and strength. In this regard, a railroad tie should, in general, exhibit the following minimal physical properties:

| | |
|---|---|
| compression modulus: | at least about 172,000 psi |
| flexural modulus: | at least about 172,000 psi |
| compression yield stress: | at least about 3,000 psi |
| compression strength: | at least about 3,000 psi |
| flexural strength: | at least about 3,000 psi |

Another factor regarding maintaining the proper distance between rails is thermal expansion. To be suitable as a railroad tie, the material must exhibit a low thermal expansion. Preferably, the material has a coefficient of thermal expansion of less than $6\times10^{-5}$ in/in·° F.

Ties are exposed to large temperature variations, excessive amounts of ultraviolet light, severe weather conditions, attack from microorganisms and insects, and stress imposed by use. Thus, to prevent the occurrence of accidents, the materials used for manufacturing railroad ties need to be stiff, strong and resistant to ultraviolet light, temperature fluctuations, and microbe/insect attack.

Also, the material used for ties should be nonconductive to preclude electrical flow between the rails. For example, for freight railways, electrical signals are sent through the rails for purposes of communication between the front and back of the train. For passenger railways, electrical power is often sent through the rails themselves. Therefore, to prevent electrical shorts between the rails, the ties supporting the rails should be made from nonconductive materials.

The tie material should also be durable to avoid deterioration due to abrasion during use. For example, one form of abrasion associated with railroad ties is tie seat abrasion. This occurs when the tie plates cut into the ties. Ties that are made from materials that are stiffer and stronger than wood in the direction perpendicular to the tie axis are better at alleviating tie seat abrasion.

Since the rails are to be attached to the ties, the tie material also has to be suitable for use with typical types of fasteners, such as those used for wood materials, e.g., nails, screws, spikes, bolts, etc.

Typically, railroad ties are manufactured from wood, and to some extent steel-reinforced concrete. While wood is a relatively inexpensive material, it is very susceptible to attack from microorganisms such as fungi and insects, which will weaken and deteriorate the tie. To compensate for this, wooden railroad ties are often subjected to chemical treatments such as creosote treatment and chromate/copper/arsenic treatment. These treatments greatly increase costs. Further, chemical treatments only delay attack, not prevent it. Such treated woods also raise environmental concerns. Wooden ties are also quite susceptible to damage from harsh weather conditions and excessive sunlight. As a result of these drawbacks, wooden ties require frequent replacement or regauging, again increasing costs, in materials, labor, and disposal. Replacement and/or regauging costs can be quite substantial as ties are being utilized in numbers of about 3000 ties per mile.

Similarly, steel-reinforced concrete railroad ties are also susceptible to degrading forces, for example, abrasion, stress and strain. In fact, concrete ties have been found to cause premature failure of rails. This is because concrete ties are generally very stiff. As a result, when placed at the standard distance, the ties do not aid in absorbing the stress imposed on the rails thereby forcing the rails to flex more between the ties under load. To address this problem, concrete ties are often spaced closer together than wooden ties. This, of course, leads to increased costs.

Damp and freezing weather conditions cause damage to both wooden and concrete railroad ties alike. Water from rain or snow can penetrate into the surface of a wooden or concrete railroad tie. If the tie is then exposed to freezing conditions, the water will expand as it freezes, causing the formation of cracks thereby weakening the tie. In the case of reinforced concrete ties, such cracks can also lead to oxidation of the reinforcement bars.

Several attempts have been made to manufacture railroad ties from other materials, particularly polymeric and polymeric composite materials, which ameliorate the disadvantages associated with wooden and concrete ties. For example, Murray, U.S. Pat. Nos. 5,094,905 and 5,238,734, discloses making railroad ties from recycled tires. Neefe, U.S. Pat. Nos. 4,997,609 and 5,055,350, uses compression molding to manufacture a composite railroad tie from sand and granulated recycled plastics. These two components are held together by an adhesive coating material, i.e., sugar or polystyrene.

Nosker et al. (U.S. Pat. No. 5,789,477) describes railroad ties made from a composite containing coated fibers, such as fiber glass or carbon fibers, distributed within a polymer component containing about 80–100% high density polyethylene (HDPE). The polymer component can be made from recycled plastics.

Morrow et al. U.S. Pat. No. 5,298,214, hereby incorporated by reference, describes a material in which polystyrene is blended with a "mixed plastics" component from a recycling stream to produce materials that behave mechanically and appear morphologically like fiber reinforced composites. In this morphology, both the polystyrene component and predominantly polyolefin component, obtained from the "mixed plastics," exist as a dual phase microstructure. Both components form three dimensional networks that are integrated and which interpenetrate with one another. Use of this material for railroad ties is described in the recent patent Nosker et al. U.S. Pat. No. 6,191,228, also hereby incorporated by reference.

A disadvantage exhibited by new wooden ties, as well as ties made from alternative materials, such as reinforced concrete ties and the plastic and plastic composite ties described above, is slippage within the ballast that forms the bed on which the ties lie. Due to their smooth surfaces, these ties tend to slip within the ballast as a result of the forces imposed on the ties.

This effect is most pronounced in curves. In such cases, there are two primary factors which can cause the ties to slip or push out of the ballast. First, as a result of high temperatures, thermal expansion of the rails and/or the ties can cause slippage, on sharp curves, especially in the case of the newer welded rails. Second, the centripetal acceleration of a train when traversing a curve imposes additional force on rails. These two factors tend to force or push the ties out of the ballast towards the outside of the curve. Most of the serious single train accidents in the past century can be blamed on these effects.

New wooden ties and ties made from alternative materials possess smooth surfaces and thus exhibit this disadvantage of low resistance to lateral movement. For example, plastic/plastic composite ties with smooth surfaces exhibit a single tie push test value of about 1000 pounds. This test is a railroad industry standard test for measuring a tie's resistance to lateral sliding when installed in ballast. A value of 1000 pounds is comparable to that of new wooden ties. However, as wooden ties are worked into the ballast, their single tie push test values increase. After the passage of about 15 million gross tons (MGT) of rail traffic, the single tie push test values for wooden ties increases to 2500–3000 pounds. Conversely, smooth plastic ties do not exhibit any appreciable increase in single tie push test values even after significant traffic has passed over them.

There is a cost which the railroads pay for the fact that new wooden ties have low mechanical interaction with the ballast (reflected by low single tie push test results) immediately upon installation. This price is that for safety reasons they necessarily require the trains to use lower speeds whenever new wooden ties are installed, especially around curves. This cost is particularly high in locations where the tracks go over passes in high mountain ranges. In some instances, at certain times of the year, trains cannot safely traverse these passes at all during the day. This disadvantage is associated not only with new wooden ties but also ties made from alternative materials such as plastic composites which have smooth surfaces.

Previous attempts have been made to texturize a surface of a railroad tie. These attempts involved scoring the surface with wavy line patterns, box patterns, or checkerboard patterns. However, these patterns do not provide an effective texture for interacting with the ballast of the railroad bed to inhibit sliding.

SUMMARY OF THE INVENTION

An object of the invention is to provide railroad ties, preferably plastic or plastic composite ties, which increase the resistance of the ties to resist sliding within the ballast of the railroad bed, for example, sliding lengthwise (in the direction of the longitudinal axis of the tie) and/or sideways (in the direction perpendicular to the longitudinal axis, i.e., in the direction of the latitudinal axis). While the railroad ties used in the invention are preferably plastic or plastic composite ties, ties made from wood or concrete or reinforced concrete can also be used.

Upon further study of the specification and appended claims, further objects and advantages of the invention will become readily apparent to those skilled in the art.

These objects are achieved in accordance with the invention by providing the plastic and/or plastic composite ties with a textured surface which aids in anchoring the ties within the ballast of the railroad beds. In particular, the ties are provided with a pattern of indentations within a surface that contacts the ballast which increases the ties resistance to sliding, especially in the direction along the longitudinal axis. These indentations are preferably designed to inhibit such sliding while minimizing stress within the ties so as to avoid stress raisers. The indentations have a depth of at least ⅛ of an inch (e.g. ⅛ to 1 inch) and the indentations are inclined at an angle of less than 90°.

The pattern is molded into the ties so as to mechanically interact with the ballast (rocks) and provide as much resistance to sliding as possible, especially along the longitudinal axis of the tie but also in the direction perpendicular to the longitudinal axis. Providing the pattern of indentation is preferably performed in a manner which does not compromise: (1) the overall tie dimensions (typically 7"×9" or 6"×8" in cross-section in the U.S., but could be adjusted for other dimensions); (2) the mechanical integrity of the tie; and/or (3) the ability of the tie to accept screw or cut spikes while preventing penetration of the spike through the bottom tie surface. The size, shape and positions of the indentations are preferably selected to provide efficient transfer of stress between the tie and the ballast while at the same time minimizing the internal stress within the tie itself. This assures that the tie will maintain its strength and integrity over a long time period. It also allows the tie to be removed during maintenance of the rails and then replaced upon completion of the rail maintenance.

Generally, the indentation pattern comprises two structural aspects: the size and shape of the concave impressions placed in the tie surface, and the relative location of each indentation.

BRIEF DESCRIPTION OF THE DRAWING

The present invention will be more fully appreciated as the same becomes better understood when considered in conjunction with the accompanying drawings, in which like reference characters designate the same or similar parts throughout the several views, and wherein.

Figure 1:
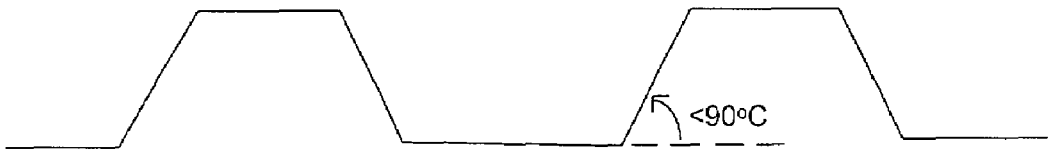
FIG. 1 illustrates a cross section of truncated cone indentations on a tie.

The shapes of the indentations can vary. For example, the shapes can be diamond, oval, square, rectangular, hemispherical, octagonal, etc., having angled sidewalls. Preferably, the shapes of the indentations are either a truncated cone or a truncated pyramid. The impressions within a particular tie can be all the same or can be different. For example, a tie can exhibit both truncated cone indentations (as shown in, for example, FIG. 1) and truncated pyramid indentations.

Figure 2:
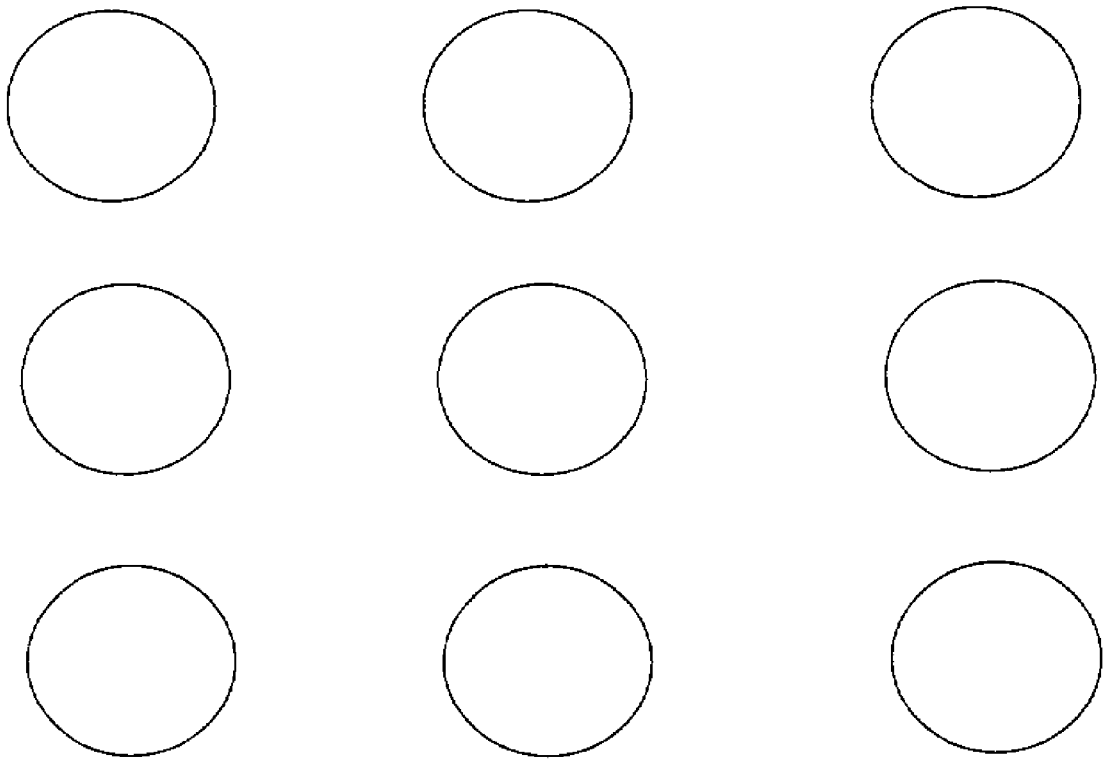
FIG. 2 illustrates another shape and arrangement variation of indentations.
Figure 3:
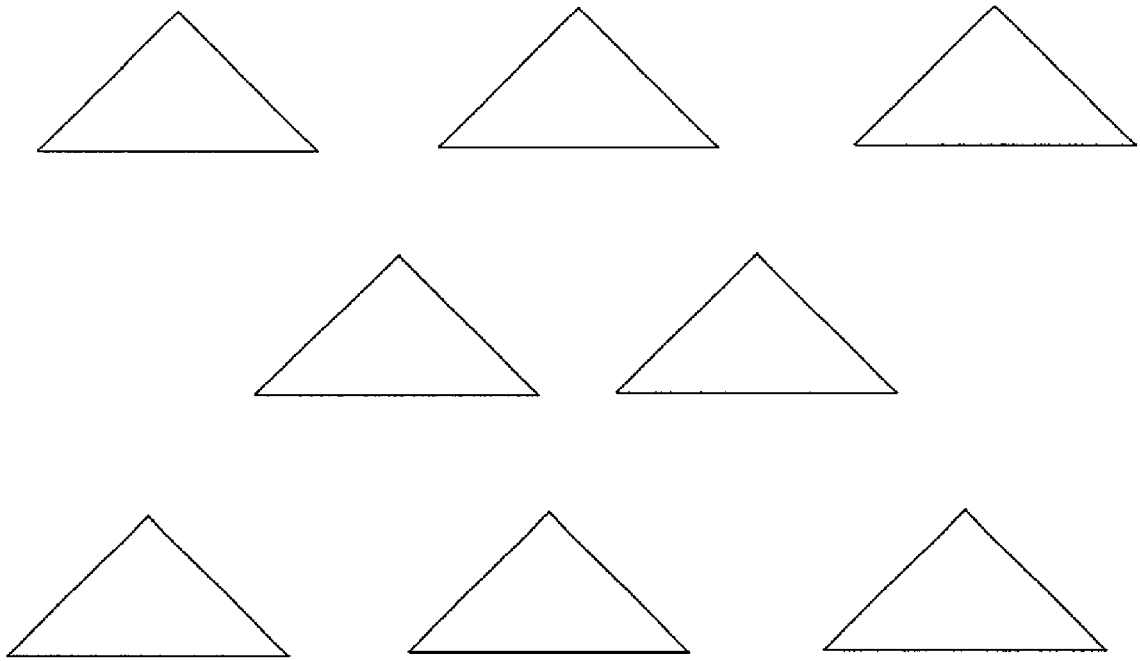
FIG. 3 illustrates a further shape and arrangement variation of indentations.

These shapes are repeated, regularly or irregularly, preferably regularly, along the bottom and/or the sides of the tie. The locations of the shapes can be regular such as rows and columns. See, e.g., FIG. 2. Alternatively, the pattern can be staggered or the indentations can be randomly distributed.

This pattern (the combination of size, shape and location of the concave shapes) permits the ballast rocks to nest into the spaces thereby enhancing mechanical interlocking between the rocks and the tie and increasing the tie's resistance to motion within the ballast.

The angled depressions which are, cut, molded, or embossed into the tie, preferably have sidewalls which form an angle with respect to the longitudinal axis of the tie of 30°–60°, especially 40°–50°, particularly 42.5°–47.5°, particularly about 45 degrees. An angle of about 45° optimizes the tie's resistance to motion within the ballast while offering the lowest value of shear stress in both the tie material and the nested rocks. As a result, mechanical resistance to lateral movement of the tie can be optimized, while minimizing the level of stress actually borne within the tie itself. The latter lowers the possibility that the tie itself will fracture as a result of the tie-ballast interaction. A stress analysis utilizing either Mohr's Stress Plane or Slip Line theory shows that an angle of about 45° will minimize internal tie stress while enhancing the tie-ballast interaction so as to reduce sliding.

The size of the shapes, cut, molded or embossed into the tie, at their base can vary. The size of the base of the shapes is generally selected to optimally fit typical ballast sized rocks within the concave shape, much as an egg fits into a nest. Preferably, the base of the shapes has a relative diameter of ½" to 2½", especially ¾" to 2", particularly in the cases of the truncated cone or truncated pyramid shapes.

The depth of the shapes to be molded or embossed into the tie can also vary, but preferably is ⅛" to ¾", especially ¼" to ½". The shapes are preferably deep enough to allow significant mechanical interaction between the tie and ballast, but not deep enough into the tie to interfere significantly with the spike-tie interaction.

In a preferred embodiment, the depth of the shapes in the regions below where the tie comes into contact with a tie plate is less than 1", for example, ⅛" to ¾", especially ¼ to ½. However, the depth of the shapes in other regions can be up to 2 inches. Since the regions beneath the tie plates are where the railroad spikes or other fastening means are attached, it is desirable to limit the depth of the indentations so that attachment of the spikes will not induce splitting of the tie.

Generally, the tie plates are attached to the ties in a region which is 10" to 36" from each end, the tie plate generally being about 20" wide. Thus, for example, for an 8.5 feet long tie having the indentations on the bottom longitudinal surface, on each end the first 10 inches can have indentations with a depth up to 2 inches deep. Thereafter, there is a region of, e.g., 26 inches long on each end where the indentations have a depth of less than 1 inch. The middle region of, e.g., 2.5 feet can have indentations with a depth up to 2".

The spacing between the indentations can also vary. Preferably, the distance from the center of one indentation to the center of an adjacent indentation is about 1½ to 2½ inches, especially 1¾ to 2¼ inches, and in particular 1⅞ to 2⅛ inches.

The pattern can be molded into the tie in a simple and inexpensive manner as part of a batch molding process. For example, a thin steel embossed plate approximately the length of the tie and slightly thinner than the sides and the bottom dimensions of the tie is placed into the mold at the bottom and/or sides prior to filling the mold with the molten plastic composition. The plastic flows into the mold, taking on the shape of the embossed plates. After cooling, the tie and plates are removed from the mold. The plates are then separated from the tie and placed back in the mold for the next molding cycle. Alternatively to embossed steel plates, other metal plates which are either embossed or have metal shapes fastened to them by, e.g., welding or with screws can be used.

In addition, the pattern can be embossed into the ties as part of a batch mold or extrusion process or as part of a continuous extrusion process. For example, extruded or molded parts are fed continuously or intermittently through a device comprising at least one heated roller, with the desired shapes attached thereto or machined into it, and at least one opposing roller which presses the plastic tie against the heated roller to mold the pattern into the tie.

Alternatively, the embossing can be performed using platens, rather than rollers. For example, a plastic tie can be inserted between the two or more platens of a press. One platen has a heated tool with the desired shapes attached thereto or machined into it. The other platen is cold and supports the plastic tie. The heated platen is pressed into the plastic tie to mold the pattern into the tie.

Alternative methods for providing the pattern of concave shapes into the surface of tie include laser cutting, chiseling, machining cutting, and the like.

The invention can be used with any type of polymeric or polymer composite tie. For example, the material for manufacturing the ties preferably have a continuous plastic phase. The polymers are preferably polyolefins, especially polyethylene, particularly HDPE. Polystyrene and rubber can also be used in the polymer component. The polymer component can be used alone or in combination with a filler or reinforcing component such as fiber glass, mineral fillers (e.g., talc and/or gypsum), wood fibers, steel fibers. The polymer component is preferably 35 to 100 wt %, more preferably 40 to 100 wt %, and especially at least 50 wt % of the total composition. The filler/reinforcement component is preferably 0 to 65 wt %, especially 0 to 60 wt % of the total composition. The following are examples of suitable combinations of material: (1) HDPE and fiberglass; (2) HDPE, polystyrene and fiberglass; (3) HDPE, polypropylene and fiber glass; (4) HDPE and talc and/or gypsum; (5) HDPE, rubber, mineral filler and fiber glass; (6) HDPE, PP and wood fiber; (7) HDPE and wood fiber; and (8) HDPE, PS and wood fiber.

In accordance with a preferred embodiment, the ties are polymeric composites of a polystyrene component and a polyolefin component described in U.S. Pat. No. 6,191,228.

According to a further aspect of the invention, the patterned ties are used in a method for maintaining desired spacing between railroad rails. Additionally, the invention includes a method of providing a weight bearing support surface for railroad rails using the patterned ties. A further aspect of invention provides a method of patterning a plastic or polymeric composite railroad tie, e.g., by molding or embossing.

Thus, the invention provides a plastic or plastic composite railroad tie having an arrangement of concave shapes or at least one longitudinal surface thereof to increase the ties resistance to sliding within the ballast of a railroad bed.

In accordance with another aspect, the invention provides such a patterned railroad tie wherein the railroad tie is formed from a plastic composite material comprising 20–50 wt % of a polystyrene component and 50–80 wt % of a polyolefin component, and wherein the polystyrene component contains at least 90 wt % polystyrene and the polyolefin component contains at least 75 wt % high density polyethylene.

In accordance with another aspect of the invention, there is provided a method of providing a weight bearing support surface for railroad rails by attachment of the rails to at least one railroad tie, the improvement wherein:

the at least one railroad tie is formed from a plastic composite material comprising 20–50 wt % of a polystyrene component and 50–80 wt % of a polyolefin component wherein the polystyrene component contains at least 90 wt % polystyrene and the polyolefin component contains at least 75 wt % high density polyethylene, and wherein the railroad tie has an arrangement of concave shapes on at least one longitudinal side thereof.

In accordance with a further aspect of the invention there is provided a method of maintaining desired spacing between railroad rails by attachment of the rails to at least one railroad tie, the improvement wherein the at least one railroad tie is formed from a plastic composite material comprising 20–50 wt % of a polystyrene component and 50–80 wt % of a polyolefin component wherein the polystyrene component contains at least 90 wt % polystyrene and the polyolefin component contains at least 75 wt % high density polyethylene, and wherein the railroad tie has an arrangement of concave shapes on at least one longitudinal side thereof.

In accordance with a preferred embodiment the invention, the railroad tie is made from a polymeric composite material consisting essentially of a polystyrene component in the amount of 20–50 wt. % and a polyolefin component of 50–80 wt. %. Preferably, the composite contains about 25 to 45 wt. %, especially 30 to 40 wt. % of the polystyrene component. Further, the composite preferably contains about 55 to 75 wt. %, especially about 60 to 70 wt. % of the polyolefin component. A particularly preferred embodiment of the composite contains 35 wt. % of the polystyrene component and 65 wt. % of the polyolefin component.

The polystyrene component is preferably 100 wt. % polystyrene although a minor manner of impurities, organic or inorganic, may be included such as foodstuffs. These impurities, on a dried basis, can be present in an amount of up to about 10 wt. %. The polyolefin component can be made from a mixture of polyolefin materials, e.g., high-density polyethylene, low density polyethylene, polypropylene, ethylene-propylene copolymers and the like. The polyolefin component should contain at least 75 wt. % high density polyethylene to insure formation of a dual phase co-continuous interlocking three-dimensional network between the polystyrene component and the polyolefin component.

While both polystyrene component and polyolefin component can be made from virgin materials, these materials are preferably formed from recycled plastics. Sources of recycled polystyrene include styrofoam cups and containers, rigid styrene tableware, clothing hangers, and other containers. The recycled polystyrene can be utilized in any of its commonly available forms, for example, foamed (expanded) polystyrene, crystal polystyrene (general purpose), and high impact polystyrene. Plastics for the polyolefin component can be obtained from the recycling of PET and HDPE beverage containers and other containers (e.g., 5 gallon pails and 55 gallon drums). However, the polyolefin can also be obtained from the mixed plastics portion of recycled stream obtained after removal of PET and unpigmented HDPE beverage containers. The ability to utilize this mixed plastics or commingled plastic portion provides both economic and environmental advantages.

The polyolefin component preferably contains at least 80 wt. % high-density polyethylene and especially 90 wt. % high-density polyethylene. Other possible materials within the polyolefin component include up to 25 wt. % of polyvinyl chloride; middle, low and/or low linear polyethylene; polypropylene; polystyrene; polyethylene terephthalate; polyolefin copolymers; and mixtures thereof.

In addition to the polystyrene and polyolefin components, the composite may contain further additives. For example, the material used to make the composite can contain small amounts of a blowing agent to reduce the number and size of voids formed within the material during cooling. The amount of can be, for example, less than 0.3 wt. %, e.g., about 0.03 wt. %. The blowing agent, e.g., azodicarbonamide, can be mixed in with the resin powder. Alternatively, other foaming agents or gases can be directly metered into the extruder. Other additives such as pigments and UV resistant agents can also be added, for example, carbon black.

While the composite material is described in terms of the polystyrene/polyolefin system, it is possible, as described in U.S. Pat. No. 6,191,228, to utilize other materials to achieve a composite possessing the desired dual-phase morphology of wherein the phases intertwine such that they remain continuous throughout the composite material.

Preferably, the composite material has a compression modulus of at least about 172,000 psi, especially at least about 200,000 psi. The composite material further exhibits a compression strength of preferably at least about 3,000 psi, especially at least about 3,500 psi, and a compression yield stress of preferably at least about 3,000 psi, especially at least about 3,500 psi.

The flexural modulus of the composite material is preferably at least about 172,000 psi, especially at least about 200,000 psi, and the flexural strength is preferably at least about 3,000 psi, especially at least about 3,500 psi.

Compression modulus, compression strength, and compression yield stress are measured in accordance with ASTM Test No. D6108. Flexural modulus, flexural strength and yield stress (in stress) are measured in accordance with ASTM Test No. D6109.

Further, the composite material preferably has a coefficient of thermal expansion of less than about $6.5\times10^{-5}$ in/in–° F., especially less than about $6.0\times10^{-5}$ in/in–° F.

Processes for preparing railroad ties from the preferred composite materials by both batch and continuous processes are described in U.S. Pat. No. 6,191,228. Further details on extrusion of polystyrene/polyolefin composite material are provided in Morrow et al. U.S. Pat. No. 5,298,214.

The size of railroad ties will vary from country to country. In the U.S., the standard railroad tie size for main rail lines is about 9 inches wide by 7 inches thick by approximately 8.5 feet long. For short lines, the size of the ties is about 6 inches by 8 inches by 8.5 feet. For some freight and passenger lines in which a third rail is used, the ties can be 7 inches by 9 inches by 10 feet or 6 inches by 8 inches by 10 feet. In fact, for switch sets of rails the ties can be even longer, for example, up to 17 feet long.

In the foregoing and in the following example, all temperatures are set forth uncorrected in degrees Celsius; and, unless otherwise indicated, all parts and percentages are by weight.

The entire disclosure of all applications, patents and publications, cited above and below, is hereby incorporated by reference.

EXAMPLE

For example, a mixture of 20 wt % polystyrene and 80 wt % polyethylene was extruded at a temperature of about 200° C. into a mold having the dimensions of 7"×9"×8½". The mold contained a steel embossed plate approximately the length of the tie and slightly thinner than the sides and the bottom dimensions of the tie. The plate has a convex pattern of truncated pyramidal shapes having a depth of ⅜" and a width of 1". The truncated pyramidal shapes have sidewalls that are inclined at an angle of 45° and the indentations are in alternating pattern of a row of two and a row of three. The plastic flows into the mold, taking on the shape of the embossed plate. After cooling, the tie and plate is removed from the mold.

From the foregoing description, one skilled in the art can easily ascertain the essential characteristics of this invention, and without departing from the spirit and scope thereof, can make various changes and modifications of the invention to adapt it to various usages and conditions.

We claim:

1. A railroad tie comprising:

a railroad tie having at least four longitudinal sides, two end faces and a longitudinal axis, wherein at least one longitudinal side has an arrangement of concave shapes in the surface thereof, said shapes having a depth of at least ⅛ of an inch and having sidewalls which are at an angle of less than 90°, wherein said tie is made from polymeric material, and said concave shapes are in the form of truncated cones in which the sides of the truncated cone shapes are at an angle of 30–60 degrees with respect to said at least one longitudinal side, or said concave shapes are truncated pyramidal shapes in which the sides of the truncated pyramidal shapes are at an angle of 30–60 degrees with respect to said at least one longitudinal side, wherein said concave shapes are in the form of truncated cones.

2. A railroad tie according to claim 1, wherein the concave shapes at their base have a relative diameter of ¾–2 inches.

3. A railroad tie according to claim 1, wherein the concave shapes have a depth of ¼–½ inches.

4. A railroad tie according to claim 2, wherein the concave shapes have a depth of ¼–½ inches.

5. A railroad tie according to claim 4, wherein the sides of the truncated cone shapes are at an angle of 40–50 degrees with respect to said at least one longitudinal side.

6. A railroad tie according to claim 5, wherein said tie is formed from a plastic composite material comprising 20–50 wt % of a polystyrene component and 50–80 wt % of a polyolefin component, and said polystyrene component contains at least 90 wt % polystyrene and said polyolefin component contains at least 75 wt % high density polyethylene.

7. A railroad tie according to claim 4, wherein said tie is formed from a plastic composite material comprising 20–50 wt % of a polystyrene component and 50–80 wt % of a polyolefin component, and said polystyrene component contains at least 90 wt % polystyrene and said polyolefin component contains at least 75 wt % high density polyethylene.

8. A railroad tie according to claim 4, wherein the distance from the center of one concave shape to the center of an adjacent concave shape is 1½ to 2½ inches.

9. A railroad tie according to claim 1, wherein said tie is formed from a material comprising a polymeric component selected from polyolefins, polystyrene, rubber and mixtures thereof, and optionally a filler component selected from fiber glass, mineral fillers, wood fibers, steel fibers and mixtures thereof.

10. A railroad tie according to claim 9, wherein said polymer component contains HDPE.

11. A railroad tie according to claim 9, wherein said tie contains: (1) HDPE and fiberglass; (2) HDPE, polystyrene and fiberglass; (3) HDPE, polypropylene and fiber glass; (4) HDPE and talc and/or gypsum; (5) HDPE, rubber, mineral filler and fiber glass; (6) HDPE, polypropylene and wood fiber; (7) HDPE and wood fiber or (8) HDPE, polystyrene, and wood fiber.

12. A railroad tie according to claim 1, wherein said tie is formed from a plastic composite material comprising 20–50 wt % of a polystyrene component and 50–80 wt % of a polyolefin component, and said polystyrene component contains at least 90 wt % polystyrene and said polyolefin component contains at least 75 wt % high density polyethylene.

13. In a method of maintaining desired spacing between railroad rails comprising attaching said rails to at least one railroad tie, the improvement wherein said at least one railroad tie is in accordance with claim 1.

14. In a method of providing a weight bearing support surface for railroad rails comprising attaching said rails to at least one railroad tie, the improvement wherein said at least one railroad tie is in accordance with claim 1.

15. A railroad tie comprising:

a railroad tie having at least four longitudinal sides, two end faces and a longitudinal axis, wherein at least one longitudinal side has an arrangement of concave shapes in the surface thereof, said shapes having a depth of at least ⅛ of an inch and having sidewalls which are at an angle of less than 90°, wherein said tie is made from polymeric material, and said concave shapes are in the form of truncated cones in which the sides of the truncated cone shapes are at an angle of 30–60 degrees with respect to said at least one longitudinal side, or said concave shapes are truncated pyramidal shapes in which the sides of the truncated pyramidal shapes are at an angle of 30–60 degrees with respect to said at least one longitudinal side, wherein said concave shapes are truncated pyramidal shapes, and said concave shapes at their base have a relative diameter of ¾–2 inches.

16. A railroad tie according to claim 15, wherein the concave shapes have a depth of ¼–½ inches.

17. A railroad tie according to claim 15, wherein the concave shapes have a depth of ¼–½ inches.

18. A railroad tie according to claim 17, wherein the sides of the truncated pyramidal shapes are at an angle of 40–50 degrees with respect to said at least one longitudinal side.

19. A railroad tie according to claim 18, wherein said tie is formed from a plastic composite material comprising 20–50 wt % of a polystyrene component and 50–80 wt % of a polyolefin component, and said polystyrene component contains at least 90 wt % polystyrene and said polyolefin component contains at least 75 wt % high density polyethylene.

20. A railroad tie according to claim 17, wherein the distance from the center of one concave shape to the center of an adjacent concave shape is 1½ to 2½ inches.

21. A railroad tie according to claim 17, wherein said tie is formed from a plastic composite material comprising 20–50 wt % of a polystyrene component and 50–80 wt % of a polyolefin component, and said polystyrene component contains at least 90 wt % polystyrene and said polyolefin component contains at least 75 wt % high density polyethylene.

22. A railroad tie according to claim 15, wherein said tie is formed from a material comprising a polymeric component selected from polyolefins, polystyrene, rubber and mixtures thereof, and optionally a filler component selected from fiber glass, mineral fillers, wood fibers, steel fibers and mixtures thereof.

23. A railroad tie according to claim 22, wherein said tie contains: (1) HDPE and fiberglass; (2) HDPE, polystyrene and fiberglass; (3) HDPE, polypropylene and fiber glass; (4) HDPE and talc and/or gypsum; (5) HDPE, rubber, mineral filler and fiber glass; (6) HDPE, polypropylene and wood fiber; (7) HDPE and wood fiber or (8) HDPE, polystyrene, and wood fiber.

24. A railroad tie according to claim 15, wherein said tie is formed from a plastic composite material comprising 20–50 wt % of a polystyrene component and 50–80 wt % of a polyolefin component, and said polystyrene component contains at least 90 wt % polystyrene and said polyolefin component contains at least 75 wt % high density polyethylene.

25. In a method of maintaining desired spacing between railroad rails comprising attaching said rails to at least one railroad tie, the improvement wherein said at least one railroad tie is in accordance with claim 15.

26. In a method of providing a weight bearing support surface for railroad rails comprising attaching said rails to at least one railroad tie, the improvement wherein said at least one railroad tie is in accordance with claim 15.

* * * * *